US005116521A

United States Patent [19]

Fujii et al.

[11] Patent Number: 5,116,521

[45] Date of Patent: May 26, 1992

[54] AQUEOUS LUBRICATION TREATMENT LIQUID AND METHOD OF COLD PLASTIC WORKING METALLIC MATERIALS

[75] Inventors: Hiroyuki Fujii, Chiryu; Tokuo Shirai; Takanori Mizutani, both of Aichi; Yoshio Nagae, Osaka; Koji Hetsugi, Hiratsuka; Yasuo Tanizawa, Yamato; Kouji Kaburagi, Yokohama, all of Japan

[73] Assignees: Nippondenso Co., Ltd., Kariya; Nihon Parkerizing Co., Ltd., Tokyo, both of Japan

[21] Appl. No.: 564,461

[22] Filed: Aug. 8, 1990

[63] Continuation-in-part of Ser. No. 375,973, July 6, 1989, abandoned.

[30] Foreign Application Priority Data

Jul. 7, 1988 [JP] Japan ..... 63-167849
Aug. 9, 1989 [JP] Japan ..... 1-204585

[51] Int. Cl.[5] ..... C10M 125/00; C10M 103/00

[52] U.S. Cl. ..... 251/18; 252/25; 252/28; 252/37.2; 252/40.7; 252/49.5; 72/42

[58] Field of Search ..... 252/18, 25, 30, 28, 252/49.5, 37.2, 40.7; 72/41, 42

[56] References Cited

U.S. PATENT DOCUMENTS

| | | | |
|---|---|---|---|
| 2,310,239 | 2/1943 | Jernstedt | 148/6 |
| 2,588,234 | 3/1952 | Henricks | 148/6.15 |
| 2,874,081 | 2/1959 | Cavanagh et al. | 148/6.15 |
| 3,629,112 | 12/1971 | Gower et al. | 252/34.7 |
| 3,843,529 | 10/1974 | Bertrand | 252/30 |
| 4,071,368 | 1/1978 | Jones | 252/30 |
| 4,148,970 | 4/1979 | McIntosh et al. | 252/18 |
| 4,303,537 | 12/1981 | Laepple et al. | 252/30 |
| 4,715,972 | 12/1987 | Pacholke | 252/30 |

FOREIGN PATENT DOCUMENTS

| | | |
|---|---|---|
| 30-003258 | 4/1955 | Japan . |
| 0503897 | 3/1976 | Japan . |
| 61-183394 | 8/1986 | Japan . |
| 62-100595 | 5/1987 | Japan . |

*Primary Examiner*—Margaret Medley
*Attorney, Agent, or Firm*—Cushman, Darby & Cushman

[57] ABSTRACT

An aqueous lubrication treatment liquid for a cold plastic working of a metallic material comprises 50 to 400 g/l of a solid lubricant, for example, $MoS_2$, 1 to 40 g/l of a surfactant, 10 ppm to 5000 ppm, in terms of colloidal titanium compound, water, and optionally, 5 to 150 g/l of a binder and 4 to 160 g/l of a metallic soap. This liquid exhibits a strong bonding to the metallic material and an excellent lubricating property, and prevents rusting of the metallic material.

4 Claims, No Drawings

AQUEOUS LUBRICATION TREATMENT LIQUID AND METHOD OF COLD PLASTIC WORKING METALLIC MATERIALS

CROSS REFERENCE TO RELATED APPLICATION

This application is a continuation-in-part of our application Ser. No. 07/375,973 filed on Jul. 6, 1989, now abandoned.

BACKGROUND OF THE INVENTION

1. Field of the Invention

This invention relates to an aqueous lubrication treatment liquid and a method of cold plastic working metallic materials.

More particularly, this invention relates to an aqueous liquid used in a lubrication treatment for a cold plastic working (forging, tube drawing, wire drawing, etc.) of a steel, stainless steel, titanium-based metal, copper-based metal, aluminum-based metal material, etc. (hereinafter referred to as an aqueous lubrication treatment liquid) as well as a method of cold plastic working of a metallic material having a chemical conversion coating thereon with the aqueous lubrication treatment liquid.

2. Description of the Related Arts

As an aqueous lubrication treatment liquid currently used for the cold plastic working of a metallic material, liquids which comprise a solid lubricant, for example, molybdenum disulfide and graphite, at least one member selected from inorganic binders and organic binders, and a surfactant are known.

When a cold working is carried out at a relatively small reduction, a method in which an aqueous lubrication treatment liquid is brought directly into contact with a surface of a metallic material free from grease, followed by drying to form a solid lubricant film, is known.

In the case of a high reduction cold working, a method is employed of forming a solid lubricant film over a chemical conversion coating where a metallic material surface, after the formation of the chemical conversion coating, is brought into contact with an aqueous lubrication treatment liquid, followed by drying, or has a solid lubricant powder deposited thereon. Using a solid lubricant in a powder state, however, causes a problem of a deterioration of the working environment, and thus most preferably a lubricant in the form of an aqueous treatment liquid is used. In this case, however, a conventional aqueous lubricant treatment liquid has a drawback in that it causes rusting of the treated or formed metallic material when left to stand after the treatment or forming.

In the above cases, the currently used treatment agents cannot provide a stable and desired lubricity, which often results in the problems of seizing and galling.

SUMMARY OF THE INVENTION

An object of the present invention is to provide an aqueous lubrication treatment liquid for cold plastic working of a metallic material, which liquid does not have the above-mentioned disadvantages of conventional aqueous lubrication treatment liquids, and exhibits a high workability, adhesion to metallic materials, stability and lubricating property, without causing a rusting of the metallic materials, and a method of an aqueous lubrication treatment for cold plastic working the metallic material with the aqueous lubrication treatment liquid.

The above-mentioned object will be attained by the aqueous lubrication treatment liquid of the present invention for cold plastic working of a metallic material, which comprises 50 to 400 g/l of a solid lubricant; 0.5 to 40 g/l of a surfactant for uniformly dispersing the solid lubricant in water; a colloidal titanium compound prepared by neutralizing at least one member selected from the group consisting of compounds of sulfuric acid with titanium and of phosphoric acid with titanium, and in an amount of 10–5000 ppm in terms of titanium; and water.

In addition to the above components, according to the present invention, the aqueous lubrication treatment liquid optionally further contains a binder in an amount of 5 to 150 g/l.

Further, the aqueous lubrication treatment liquid of the present invention optionally further comprises 4 to 160 g/l of a metallic soap.

The aqueous lubrication treatment method of the present invention for cold plastic working of metallic materials is carried out by the treatment of a metallic material surface coated with a chemical conversion layer, with the above aqueous lubrication treatment liquid as mentioned above.

DESCRIPTION OF THE PREFERRED EMBODIMENTS

The solid lubricant usable for the aqueous lubrication treatment liquid according to the present invention preferably consists essentially of at least one member selected from the group consisting of molybdenum disulfide, graphite, tungsten disulfide, fluorinated graphite, boron nitride and talc.

The content of solid lubricant in the treatment liquid is 50–400 g/l, preferably 100–150 g/l. A content less than 50 g/l does not provide a sufficient formation of a solid lubricant layer on the metallic material surface, and if the content is more than 400 g/l, due to an excessive addition, the lubrication effect becomes saturated so that no further improvement of the lubrication effect is obtained, and the cost of the aqueous lubrication liquid is increased.

In the aqueous lubrication treatment liquid of the present invention, surfactant is added for dispersing a solid lubricant in water, and there is no specific limitation of the type thereof. Surfactants in general use include nonionic type surfactants, for example, polyoxyethylene alkyl ethers, polyoxyethylene alkylphenyl ethers, polyoxyethylene alkyl esters, and polyoxyethylene sorbitane alkyl esters; anionic type surfactants, for example, fatty acid salts, alkyl sulphates, alkyl sulphonate alkyl phosphates and alkyl dithiophosphates; cationic type surfactants, for example, aliphatic amine salts, and quarternary ammonium salts; and amphoteric type surfactants, for example, amino acid type and betain type carboxylic acid salts, sulfuric ester salts, sulphonic ester salts, and phosphoric ester salts.

The content of the surfactant in the aqueous lubrication liquid of the present invention is 0.5 to 40 g/l, preferably 5 to 10 g/l. The content of the surfactant is preferably increased or decreased depending on the content of the solid lubricant. Where the content of surfactant is less than 0.5 g/l, the solid surfactant in the treatment liquid is insufficiently wetted, and a greater quantity than 40 g/l does not increase the effect of the surfactant to any significant degree.

As the colloidal titanium compound to be used for the aqueous lubrication liquid of the present invention, a cloudy solution obtained by neutralizing a compound of sulphuric acid with titanium or phosphoric acid with titanium, with, for example, caustic soda or the like is used. The content of colloidal titanium compound in the aqueous lubrication liquid is 10 ppm to 5000 ppm in terms of titanium, preferably 50 ppm to 3000 ppm. Where the content of colloidal titanium compound is less than 10 ppm, there is little improvement of the lubricity due to the addition thereof, and if the content is within the scope of 10 to 5000 ppm, the effect on the lubricity of the aqueous lubrication liquid and the rust-preventive effect are increased with the increase in the content of colloidal titanium compound. The colloidal titanium compound is in the form of colloidal micelles negatively charged in water, whereas the conventional titanium compound pigments are in the form of fine particles which are not charged when disposed in water.

It is also possible to use the aqueous lubrication treatment liquid of the present invention with the addition of a defoaming agent and/or rust preventive additives, etc.

This aqueous lubrication liquid also optionally contains a binder in addition to the above-mentioned components. This binder consists of at least one member selected from inorganic binders and organic binders, and the addition of such a binder further improves the performance of the aqueous lubrication treatment liquid.

The inorganic binders include the following compounds but there is no specific restriction of type as long as they are effective for the purpose of this invention.

a. Borates

Alkali metal salts, alkali earth metal salts and ammonium salts of $HBO_2$, $H_3BO_3$, $H_4B_2O_5$, $H_2B_4O_7$, $HB_5O_8$, $H_2B_6O_{10}$, $H_2B_8O_{13}$, etc.

b. Phosphates

Alkali metal salts, alkali earth metal salts and ammonium salts of $H_3PO_4$, $HOP_3$, $H_4P_2O_6$, $H_3PO_3$, $H_4P_2O_5$, $HPO_2$, $H_3PO_2$, $H_3P_3O_9$, and polyphosphoric acids, for example, $H_4P_2O_7$, $H_5P_3O_{10}$, $H_6P_{11}O_{13}$, etc.

c. Silicates

Those expressed by the general formula $M_2O.XSiO_2$, where M denotes an alkali metal or alkali earth metal and x denotes a positive integer of 1 to 5.

Further, there is no specific restriction on the organic binders, provided that they are effective for the purpose of this invention. Known binders can be used, but preferably a water-soluble high molecular compound is used. These compounds include natural high molecular substances such as starch, sea weeds, vegetable mucilage, animal protein, and fermentation mucilage; semi-synthetic high molecular substances obtainable from starch, cellulose and the like; and synthetic polymers such as PVP, PEG, and PVA.

The content of the above-mentioned binder as a component in the aqueous lubrication treatment liquid of the present invention is 5 to 150 g/l, preferably 10 to 50 g/l. The content is usually set in accordance with the content of solid lubricant. Where the content of the binder component is less than 5 g/l, the bonding of the solid lubricant layer to the metallic material surface is unsatisfactory, and if the content of the binder exceeds 150 g/l a further strengthened bond between the solid lubricant layer and the metallic material surface is not obtained; on the contrary, the latter case may give the aqueous lubrication liquid an excessively high viscosity, causing an excessive deposit of the solid lubricant layer on the metallic material surface, thus causing clogging of the die.

Optionally, the aqueous lubrication liquid of the present invention further comprises, in addition to the above-mentioned components, 4 to 160 g/l of a metallic soap.

The metallic soap consists of a reaction product of at least one type of fatty acid with at least one type of metal, and is preferably selected from salts of lauric acid, myristic acid, palmitic acid, stearic acid, behenic acid, and hydroxystearic acid with calcium, aluminum, magnesium, barium and zinc. Preferably, the metallic salt comprises a wet state calcium stearate.

The inventors of the present invention found for the first time that, when the 50 to 400 g/l of solid lubricant and 10 to 5000 ppm of the colloidal titanium compound are employed in combination with 4 to 150 g/l of the metallic soap, the lubricating effect of the resultant treatment liquid is significantly and synergistically high.

If the amount of the metallic soap is less than 4 g/l, the synergistical effect for enhancing the lubricating property of the resultant treatment liquid is unsatisfactory. Also, if the amount of the metallic soap is increased to more than 160 g/l, the lubricating effect of the resultant treatment liquid is not increased to a level higher than that when the amount of the metallic soap is 160 g/l; instead, the lubricating effect of the solid lubricant is limited.

In the aqueous lubrication treatment liquid of the present invention, the metallic soap is employed preferably at a mixing ratio by weight of from 2:5 to 1:50 to the solid lubricant, to obtain a superior lubricating effect.

The preparation of the above-mentioned aqueous lubrication treatment liquid of the present invention can be carried out by dispersing or dissolving the above-mentioned components in prescribed quantities in water in the same way as usually practiced.

In the present invention, the metallic material surface having a chemical conversion layer is treated with the above-mentioned aqueous lubrication treatment liquid.

There is no specific restriction of the type of the chemical conversion layer on the metallic material, and, for example, zinc phosphate coating, iron oxalate coating, cuprous oxide coating, aluminum fluoride coating, and titanium fluoride coating commonly used according to the type of metals, can be used.

The aqueous lubrication treatment liquid of the present invention is usable as a treatment liquid in the as-prepared state when the total content of the components is relatively low. Where the total content is high, the treating liquid is used as it is or after an appropriate dilution with water, in consideration of the type of metal, type of cold plastic working to be applied, the reduction magnitude, etc.

The aqueous lubrication treatment liquid of the present invention is applied to a metallic material, usually by an immersion procedure wherein the temperature thereof is maintained at a level between room temperature and 80° C. Since higher temperatures of the aqueous lubrication treatment liquid improve the drying efficiency of the lubricant applied to metallic material surface, use of a heated liquid is a common practice. In this case, the viscosity of the aqueous lubrication treatment liquid must be controlled, and accordingly, when supplying the aqueous lubrication treatment liquid, water is fed to maintain the concentration at a required level.

The lubrication process using the aqueous lubrication treatment liquid of the present invention usually is carried out in the following sequence. The sequence is selected according to the type of metallic material, surface condition, type of cold plastic working, and grade of reduction.

① Degreasing—water rinsing—lubrication treatment according to the present invention—drying ② Degreasing—water rinsing—pickling—water rinsing—lubrication treatment according to the present invention—drying (pickling is carried out to remove rust and scale)

③ Degreasing—water rinsing—pickling—water rinsing—chemical conversion treatment—water rinsing—lubrication treatment according to the present invention—drying ④ Degreasing—water rinsing—chemical conversion treatment—water rinsing—lubrication treatment according to the present invention—drying (Degreasing is effected only when necessary)

In the above-mentioned lubrication treatment stage, a solid lubricant layer is formed on the metallic material surface or on the chemical conversion layer, and fine particles of colloidal titanium compound in the lubricant layer and the solid lubricant cooperate therein to create a synergistic effect and thus provide an excellent lubrication performance. The colloidal titanium compound absorbed by immanent corrosive components functions provide the metallic material surface with a higher resistance to corrosion. This is an additional effect of this lubrication process.

EXAMPLES

The present invention will be further explained by way of Examples and Comparative Examples, which in no way limit this invention.

EXAMPLES 1-23 AND COMPARATIVE EXAMPLES 1-11

In each of these examples and comparative Examples, the metallic materials listed in Table 1 were subjected to the following treatment.

Degreasing→water rinsing→pickling→water rinsing→(chemical conversion treatment)→water rinsing→lubrication treatment→drying In the degreasing stage, the metallic material was treated in a solution containing 20 g/l of Fine Cleaner 4360 (trade mark of degreasing chemical, a product of Nihon Parkerizing Co.) at 70° C. for 10 min.

In each water rinse stage, the metallic material was treated with running city water at R.T. for 60 sec.

The pickling and chemical conversion treatment steps were conducted as shown in Table 1.

The lubrication treatment step was conducted with the lubricant having the compositions and under the conditions shown in Table 2.

The drying step was conducted with a hot air dryer at 120° C. for 30 min.

TABLE 1

| | Conditions of Pickling and Chemical Conversion | | | |
|---|---|---|---|---|
| Example No. | Type of Steel | Pickling | Chemical Conversion | |
| Example | | | | |
| 1 to 3 | Carbon steel | HCl 15% | PB-181X*2 | 90 g/l |
| 20 and | S20C | Inhibitor*1 | AC-131*2 | 0.3 g/l |
| 23 | (JIS, Carbon steel for machine structure) | Room temperature Immersion 10 min | 80° C., immersion 15 min | |
| 4 and 5 | | | Not treated | |
| 6 and 21 | Stainless steel | $HNO_3$ 7% | FB-A1 reagent*2 | 40 g/l |
| | SUS 410L | HF 3% | FB-A2 reagent*2 | 20 g/l |
| | (JIS) | Room temperature | AC-16*2 | 1 g/l |
| | | Immersion 10 min | 90° C., immersion 15 min | |
| 7 and 22 | Titanium | | MET-3851*2 | 36 g/l |
| | (second type) | | 60° C., immersion 3 min | |
| 8 | | | Not treated | |
| 9 to 17 | Carbon steel | Ivit 700A*3 0.005% | PB-181X*2 | 90 g/l |
| | S43C | | AC-131*2 | 0.3 g/l |
| | (JIS G4051) | | 80° C., immersion 15 min | |
| 18 and 19 | | | Not treated | |
| Comparative Example | | | | |
| 1 | Carbon steel | Identical to | Not treated | |
| | S20C (JIS) | Example 1 | | |
| 2 to 4 | | | Identical to Example 1 | |
| 5 to 6 | Stainless steel | Identical to | Identical to Example 6 | |
| | | Example 6 | | |
| 7 to 8 | Titanium | Identical to | Identical to Example 7 | |
| | (second type) | Example 7 | | |
| 9 | Carbon steel | Identical to | Not treated | |
| | S43C | Example 9 | | |

TABLE 1-continued

| Conditions of Pickling and Chemical Conversion | | | |
|---|---|---|---|
| Example No. | Type of Steel | Pickling | Chemical Conversion |
| 10 to 11 | | | Identical to Example 9 |

Note
*[1]Product of Asahi Chemicals Co.
Trademark: IBIT 700A
*[2]Products of Nihon Parkerizing Co., the trademarks being abbreviated as follows:
PB-181X: Zinc phosphate type chemical conversion agent
AL-131: Accelerator for zinc phosphate type chemical conversion
FB-A1 reagent: Oxalate chemical conversion main agent
FB-A2 reagent: Oxalate chemical conversion auxiliary agent
AC-16: Accelerator for oxalate chemical conversion
MET-3851: Fluoxide type chemical conversion agent
*[3]Product of Asahi Kayaku K.K.

TABLE 2

| Composition of Lubricant and Treatment Conditions | | | | | | | | | | | | |
|---|---|---|---|---|---|---|---|---|---|---|---|---|
| Item | | | | | | | | | | | | |
| | | Composition of lubricant liquid | | | | | | | | | Treatment conditions | |
| Example No. | Symbol | Solid lubricant ($MoS_2$) (g/l) | Surfactant Type | Surfactant Amount (g/l) | Colloidal titanium compound Type | Colloidal titanium compound Amount of Ti (ppm) | Binder Type | Binder Amount (g/l) | Metallic soap Type | Metallic soap Amount (g/l) | Temperature | Immersion time (mm) |
| Example | | | | | | | | | | | | |
| 1 | A | 100 | *4 | 2 | *5 | 400 | — | — | — | — | 80 | 3 |
| 2 | B | 100 | *4 | 2 | *5 | 20 | — | — | — | — | 80 | 3 |
| 3 | C | 100 | *4 | 2 | *5 | 400 | $Na_3PO_4$ | 5 | — | — | 80 | 3 |
| 4 | A | 100 | *4 | 2 | *5 | 400 | — | — | — | — | 80 | 3 |
| 5 | C | 100 | *4 | 2 | *5 | 400 | $Na_3PO_4$ | 5 | — | — | 80 | 3 |
| 6 | C | 100 | *4 | 2 | *5 | 400 | $Na_3PO_4$ | 5 | — | — | 80 | 3 |
| 7 | C | 100 | *4 | 2 | *5 | 400 | $Na_3PO_4$ | 5 | — | — | 80 | 3 |
| 8 | C | 100 | *4 | 2 | *5 | 400 | $Na_3PO_4$ | 5 | — | — | 80 | 3 |
| 9 | D | 70 | *4 | 1 | *6 | 50 | — | — | *7 | 10 | 80 | 3 |
| 10 | E | 100 | *4 | 1 | *6 | 10 | — | — | *7 | 10 | 80 | 3 |
| 11 | F | 200 | *4 | 1 | *6 | 50 | — | — | *7 | 20 | 80 | 3 |
| 12 | G | 400 | *4 | 5 | *6 | 100 | — | — | *7 | 150 | 80 | 3 |
| 13 | H | 100 | *4 | 1 | *6 | 30 | *8 | 5 | *7 | 20 | 80 | 3 |
| 14 | I | 100 | *4 | 1 | *6 | 10 | *8 | 20 | *7 | 20 | 80 | 3 |
| 15 | J | 100 | *4 | 1 | *6 | 50 | *8 | 20 | *7 | 10 | 80 | 3 |
| 16 | K | 70 | *4 | 1 | *6 | 50 | *8 | 20 | *7 | 10 | 80 | 3 |
| 17 | L | 200 | *4 | 5 | *6 | 100 | *8 | 20 | *7 | 50 | 80 | 3 |
| 18 | M | 200 | *4 | 5 | *6 | 50 | — | — | *7 | 20 | 80 | 3 |
| 19 | N | 200 | *4 | 5 | *6 | 100 | *8 | 20 | *7 | 20 | 80 | 3 |
| Comparative Example | | | | | | | | | | | | |
| 1 | $A_C$ | 100 | *4 | 2 | — | — | $Na_3PO_4$ | 5 | — | — | 80 | 3 |
| 2 | $B_C$ | 100 | *4 | 2 | *6 | 5 | $Na_3PO_4$ | 5 | — | — | 80 | 3 |
| 3 | $A_C$ | 100 | *4 | 2 | — | — | $Na_3PO_4$ | 5 | — | — | 80 | 3 |
| 4 | $C_C$ | *9 70 | — | — | — | — | — | — | — | — | 70 | 3 |
| 5 | $A_C$ | 100 | *4 | 2 | — | — | $Na_3PO_4$ | 5 | — | — | 80 | 3 |
| 6 | $C_C$ | *9 70 | — | — | — | — | — | — | — | — | 70 | 3 |
| 7 | $A_C$ | 100 | *4 | 2 | — | — | $Na_3PO_4$ | 5 | — | — | 80 | 3 |
| 8 | $C_C$ | *9 70 | — | — | — | — | — | — | — | — | 70 | 3 |
| 9 | $D_C$ | 40 | *4 | 1 | *6 | 10 | *8 | 20 | *7 | 200 | 80 | 3 |
| 10 | $E_C$ | 100 | *4 | 1 | *6 | 4 | *8 | 20 | *7 | 0.5 | 80 | 3 |
| 11 | $G_C$ | 100 | *4 | 1 | *6 | 4 | *8 | 20 | — | — | 80 | 3 |
| Example | | graphite (g/e) | | | | | | | | | | |
| 20 | 0 | 100 | *4 | 2 | *5 | 400 | $Na_3PO_4$ | 5 | — | — | 80 | 3 |
| 21 | 0 | 100 | *4 | 2 | *5 | 400 | | 5 | — | — | 80 | 3 |
| 22 | 0 | 100 | *4 | 2 | *5 | 400 | | 5 | — | — | 80 | 3 |
| 23 | 0 | 100 | *4 | 2 | *6 | 400 | | 5 | — | — | 80 | 3 |

Note:
*4 Polyoxyethylenenonylphenolether, HLB 15, made by Daiichi Kogyo Seiyaku K.K., Trademark: Noigen EA150
*5 Neutralization product of titanyl sulfate with sodium hydroxide at a pH of 8.0
*6 Neutralization product of titanium phosphate with sodium hydroxide at a pH of 8.0
*7 Wet state calcium stearate (solid content: 30%) made in accordance with Japanese Examined Patent Publication No. 60-45680
*8 Polyvinyl pyrrolidone
*9 LUB-4601 (trademark) Sodium soap type lubricant, made by Nihon Parkerizing Co.

The metallic materials treated in each of the Examples and Comparative Examples were subjected to a backward cup extrusion test (steel) and wire drawing test (titanium) to evaluate the lubricity thereof. Also the resistance to rust development was evaluated by the constant temperature/constant humidity rusting test. The apparatuses and conditions of these tests as well as the evaluation procedure are shown in Tables 3, 4 and 5, respectively.

TABLE 3

| Cold Backward Cup Extrusion Test | | |
|---|---|---|
| Testing machine | Cold forging press machine MSF200 (Trademark) made by Fukui Kikai K.K. | |
| Test condition | Test piece | S20C • SUS410L<br>30 mmϕ × 18–43 mm (cylinder) |
| | Temperature | Room temperature |
| | Working speed | 30 spm |
| | Reduction of area | 50% |
| | Tool Punch | 20.2ϕ SKH53 |
| | Die | 30.0ϕ SKD11 |
| Evaluation | Evaluated by depth of cup*10 | |

Note:
*10Largest depth of good inner surface which could be formed without generating galling or fouling in the form of a vertical line on inside wall surface of an extruded cup was measured. The larger the cup depth of the good inner surface, the better the lubricity of the lubricant.

TABLE 4

| Wire Drawing Test | | | |
|---|---|---|---|
| Testing machine | Single head type wire drawing machine | | |
| Test condition | Test piece | | Titanium (2 type) 3 mmϕ × 12 mm |
| | Temperature | | Room temperature |
| | Drawing speed | | 50 mm/min |
| | Pass condition | 1-pass | Die diameter 2.7 mmϕ, Reduction 19.0% |
| | | 2-pass | Die diameter 2.4 mmϕ, Reduction 21.0% |
| | | 3-pass | Die diameter 2.15 mmϕ, Reduction 19.7% |
| | | 4-pass | Die diameter 1.9 mmϕ, Reduction 21.7% |
| | | 5-pass | Die diameter 1.7 mmϕ, Reduction 19.7% |
| Evaluation | Good: | | No galling formed during drawing procedure |
| | Bad: | | Galling formed |

TABLE 5

| Constant Temperature Constant Humidity Rusting Test | | |
|---|---|---|
| Testing machine | Program constant temperature constant humidity vessel GLMP-62 (Trademark), made by Futaba Kagaku K.K. | |
| Test condition | Test piece | Carbon steel S20C |
| | Temperature | 50° C. |
| | Humidity | 95% |
| | Time | 24 hours |
| Evaluation | Excellent: | No rust generated |
| | Good: | Slight rust generated |
| | Bad: | Rust generated over entire surface of test piece |

The above-mentioned test results in each Example and Comparative Example are indicated in Tables 6, 7, 8, and 9.

TABLE 6

Cold Backward Cup Extrusion Test on Carbon Steel S20C

| Example No. | Type of lubricant | Cup depth of good inner surface (mm) | Resistance to rust after cold working |
|---|---|---|---|
| Example | | | |
| 1 | A | 44 | Excellent |
| 2 | B | 40 | Excellent |
| 3 | C | 50 | Excellent |
| 4 | A | 25 | Excellent |
| 5 | C | 32 | Excellent |
| 20 | O | 44 | Excellent |
| 23 | P | 46 | Excellent |
| Comparative | | | |

TABLE 6-continued

Cold Backward Cup Extrusion Test on Carbon Steel S20C

| Example No. | Type of lubricant | Cup depth of good inner surface (mm) | Resistance to rust after cold working |
|---|---|---|---|
| Example | | | |
| 1 | $A_C$ | 16 | Bad |
| 2 | $B_C$ | 32 | Good |
| 3 | $A_C$ | 32 | Good |
| 4 | $C_C$ | 36 | Good |

TABLE 7

Cold Backward Cup Extrusion Test on Stainless Steel SUS410L

| Example No. | Type of lubricant | Cup depth of good inner surface (mm) |
|---|---|---|
| Example | | |
| 6 | C | 46 |
| 21 | O | 38 |
| Comparative Example | | |
| 5 | $A_C$ | 28 |
| 6 | $C_C$ | 32 |

TABLE 8

Wire Drawing Test on Titanium Material

| Example No. | Type of lubricant | Pass 1-st | 2-nd | 3-rd | 4-th | 5-th |
|---|---|---|---|---|---|---|
| Example | | | | | | |
| 7 | C | good | good | good | good | good |
| 22 | O | good | good | good | good | good |
| 8 | C | good | good | good | good | good |
| Comparative Example | | | | | | |
| 7 | $A_C$ | good | good | good | good | bad |
| 8 | $C_C$ | good | good | good | good | bad |

TABLE 9

Cold Backward Cup Extrusion Test on Carbon Steel S43C

| Example No. | Item | Symbol of lubricant liquid | Cup depth of good inner surface (mm) | Resistance to rust after cold working |
|---|---|---|---|---|
| Example | 9 | D | 36 | Excellent |
| | 10 | E | 44 | Good |
| | 11 | F | 40 | Excellent |
| | 12 | G | 48 | Excellent |
| | 13 | H | 50 | Good |
| | 14 | I | 48 | Good |
| | 15 | J | 44 | Good |
| | 16 | K | 40 | Good |
| | 17 | L | 54 | Excellent |
| | 18 | M | 36 | Excellent |
| | 19 | N | 30 | Excellent |
| Comparative Example | 9 | $D_C$ | 16 | Good |
| | 10 | $E_C$ | 28 | Bad |
| | 11 | $G_C$ | 32 | Bad |

As can be seen from the results of a cold forging test on carbon steel, i.e., cold backward cup extrusion test shown in Table 6, it is evident that Examples 1 to 5 wherein a colloidal titanium compound was used, show a remarkably improved lubricity compared to Comparative Examples 1 to 4 wherein such a compound was not used, and could easily endure cold working at a small reduction.

Further, the comparison between Example 2 and Comparative Examples 2 and 3 shows that the aqueous lubrication treatment liquid of the present invention containing a binder, even without a chemical conversion treatment of the metallic material, can provide a performance equivalent to that obtained with a conventional process consisting of a chemical conversion treatment and an aqueous lubrication liquid treatment. It is also seen that, when compared to Comparative Examples 1 to 4, Examples 1 to 3 show that the process of the present invention is far superior, and enables a higher reduction of cold working than considered possible to date.

Also, as seen from Table 6, the products processed according to the present invention shown in the Examples indicate no rust penetration under the constant temperature/constant humidity rusting test carried out at 50° C., at 90% humidity for 24 hr in all cases, but the Comparative Examples show that conventional products became rusty. Therefore, the present invention provides an excellent rust prevention.

Table 7 shows the result of a cold backward cup extrusion test on stainless steel. The products of the present invention in Example 6 can gain a deeper extruded cup, without defects, than can conventional products shown in Comparative Examples 5 and 6. This indicates that the aqueous lubrication treatment liquid of this invention provides an excellent lubrication effect.

The wire drawing test of titanium, as shown in Table 8, also indicated the excellent performance of the present invention's aqueous lubrication liquid as a cold working lubricant: the products of Examples 7 and 8 processed according to the present invention's liquid did not show any defect even after a 5th pass, whereas those of the Comparative Examples 7 and 8 showed defects at the 5th pass.

The present invention offers an aqueous lubrication treatment liquid and treatment method of cold working of metallic materials by which the metallic material can be given an excellent lubricity that enables a satisfactory high reduction of cold plastic working without seizure and galling, with a high workability, and giving the thus processed products a high rust resistance.

Also, as seen from Table 9, the product of Examples 9 to 19 had an excellent lubricity and a satisfactory resistance to rust, in comparison with those of Comparative Examples 9 to 11.

EXAMPLES 24 TO 26 AND COMPARATIVE EXAMPLES 12 TO 16

In each of Examples 24 to 26 and Comparative Examples 12 to 16, the same procedures as in Example 10 were carried out, except that, as the metal material, a rod having a diameter of 30 mm and consisting of a 13Cr stainless steel (SUS410L, JIS G4303) was used, the lubrication treatment liquid had the composition as shown in Table 10, the pickling was carried out by using an aqueous solution containing 7% of $HNO_3$ and 3% of HF, at room temperature for 10 minutes, the chemical conversion was carried out in the same manner as in Example 6, and the lubricating treatment was carried out at 70° C. for 3 minutes, as in Comparative Example 16.

The treated material was subjected to the cold backward cup extrusion test as shown in Table 3.

The test results are shown in Table 10.

TABLE 10

| | Item | | | | | | | | | |
|---|---|---|---|---|---|---|---|---|---|---|
| | | Composition of lubricant liquid | | | | | | | | |
| | Solid lubricant | Surfactant | | Colloidal titanium compound | | Binder | | Metallic soap | | Cup depth of good inner surface |
| Example No. | ($MoS_2$) (g/l) | Type | Amount (g/l) | Type | Amount of Ti (ppm) | Type | Amount (g/l) | Type | Amount (g/l) | (mm) |
| Example | | | | | | | | | | |
| 24 | 100 | *4 | 1 | *6 | 10 | — | | *7 | 10 | 46 |
| 25 | 200 | *4 | 1 | *6 | 50 | — | | *7 | 20 | 44 |
| 26 | 200 | *4 | 5 | *6 | 100 | *11 | 20 | *7 | 50 | 58 |
| Comparative Example | | | | | | | | | | |
| 12 | 200 | *4 | 5 | — | — | $Na_3PO_4$ | 20 | — | — | 28 |
| 13 | 200 | *4 | 5 | — | — | $Na_3PO_4$ | 3 | *7 | 1 | 28 |
| 14 | 100 | *4 | 1 | *6 | 4 | *11 | 20 | *7 | 0.5 | 32 |
| 15 | 100 | *4 | 1 | *6 | 4 | *11 | 20 | — | — | 28 |
| 16 | *9 70 | — | — | — | — | — | — | | | 32 |

EXAMPLES 27 TO 29 AND COMPARATIVE EXAMPLES 17 TO 19

In each of these Examples and Comparative Examples, the same procedures as in Example 20 were carried out, except that the metal material was a wire having a diameter of 3 mm and consisting of a second type of titanium (JIS H4600), the lubrication treatment liquid had the composition as shown in Table 11, the chemical conversion was carried out in the same manner as in Example 7, and the lubricating treatment was carried out at 70° C. for 3 minutes, as in Comparative Example 16.

The resultant treated material was subjected to the wire drawing test as shown in Table 4.

The test results are shown in Table 11.

TABLE 11

| Example No. | Solid lubricant ($MoS_2$) (g/l) | Composition of lubricant liquid: Surfactant Type | Surfactant Amount (g/l) | Colloidal titanium compound Type | Colloidal titanium compound Amount (ppm) | Binder Type | Binder Amount (g/l) | Metallic soap Type | Metallic soap Amount (g/l) | Wire drawing test Pass 1-st | 2-nd | 3-rd | 4-th | 5-th |
|---|---|---|---|---|---|---|---|---|---|---|---|---|---|---|
| Example | | | | | | | | | | | | | | |
| 27 | 100 | *4 | 1 | *6 | 10 | — | — | *7 | 10 | Good | Good | Good | Good | Good |
| 28 | 200 | *4 | 1 | *6 | 50 | — | — | *7 | 20 | Good | Good | Good | Good | Good |
| 29 | 200 | *4 | 5 | *6 | 100 | 8 | 20 | *7 | 50 | Good | Good | Good | Good | Good |
| Comparative Example | | | | | | | | | | | | | | |
| 17 | 100 | *4 | 1 | | — | 8 | 20 | *7 | 0.5 | Good | Good | Good | Good | Bad |
| 18 | 100 | *4 | 1 | | — | 8 | 20 | — | — | Good | Good | Good | Good | Bad |
| 19 | *9 70 | — | — | | — | — | — | — | — | Good | Good | Good | Good | Bad |

COMPARATIVE EXAMPLE 20

The same procedures as those in Example 1 were carried out except that the colloidal titanium compound was replaced by 400 ppm, in terms of titanium, of a non-colloidal titanium dioxide powder having an average particle size of 0.2 μm.

In the cold backward cup extrusion test, the lubrication treated carbon steel bar had a depth of a good inner surface of cup of 28 mm.

Also, in the rusting test, the resistance of the lubrication treated carbon steel bar was poor.

COMPARATIVE EXAMPLE 21

The same procedures as those in Example 6 were carried out except that the colloidal titanium compound was replaced by 400 ppm, in terms of titanium, of a non-colloidal titanium dioxide powder having an average particle size of 0.2 μm.

In the cold backward cup extrusion test, the resultant stainless steel bar had a depth of a good inner surface of the cup of 25 mm.

COMPARATIVE EXAMPLE 22

The same procedures as those in Example 7 were carried out except that the colloidal titanium compound was replaced by 400 ppm, in terms of titanium, of a non-colloidal titanium dioxide powder having an average particle size of 0.2 μm.

In the wire drawing test, the resultant titanium wire was galled in the 5th pass.

We claim:

1. A method of aqueous lubrication treatment for a cold plastic working of a metallic material, comprising treating a metallic material surface coated with a chemical conversion layer with an aqueous lubrication treatment liquid, said treatment liquid comprising:

(a) 50 to 400 g/l of a solid lubricant consisting essentially of molybdenum disulfide;

(b) 0.5 to 40 g/l of a surfactant for uniformly dispersing the solid lubricant in water;

(c) a colloidal titanium compound prepared by neutralizing at least one member selected from the group consisting of compounds of sulfuric acid with titanium and of phosphoric acid with titanium, and in concentration of 10 to 5000 ppm in terms of titanium; and (d) water;

wherein said colloidal titanium compound forms negatively charged colloidal micelles in water.

2. The method as claimed in claim 1, wherein the aqueous lubrication treatment liquid further comprises 5 to 150 g/l of a binder comprising at least one member selected from the group consisting of phosphates and silicates.

3. The method as claimed in claim 1, wherein, the aqueous lubrication treatment liquid further comprises 4 to 160 g/l of a metallic soap comprising at least one member selected from the group consisting of salts of calcium, aluminum, magnesium, barium and zinc with lauric acid, myristic acid, palmitic acid, stearic acid, behenic acid and hydroxystearic acid.

4. The method as claimed in claim 3, wherein the metallic soap is in a weight ratio of from 2:5 to 1:50 to the molybdenum disulfide solid lubricant.

* * * * *